US009388811B2

(12) United States Patent
Tang

(10) Patent No.: US 9,388,811 B2
(45) Date of Patent: Jul. 12, 2016

(54) MICROPUMP STRUCTURE

(75) Inventor: Sam Tang, Sinjhuang (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 820 days.

(21) Appl. No.: 12/489,854

(22) Filed: Jun. 23, 2009

(65) Prior Publication Data

US 2010/0322801 A1 Dec. 23, 2010

(51) Int. Cl.

| | |
|---|---|
| ***F04D 13/06*** | (2006.01) |
| ***F04D 13/08*** | (2006.01) |
| ***F04D 29/40*** | (2006.01) |
| ***F04D 29/42*** | (2006.01) |
| ***F04D 29/60*** | (2006.01) |

(52) U.S. Cl.

CPC ..... *F04D 13/06* (2013.01); *F04D 13/0606* (2013.01); *F04D 13/08* (2013.01); *F04D 29/406* (2013.01); *F04D 29/426* (2013.01); *F04D 29/605* (2013.01)

(58) Field of Classification Search

CPC . F04D 29/426; F04D 29/628; F04D 13/0606; F04D 13/06; F04D 13/0626; F04D 29/406

USPC ..... 417/423.1, 423.7, 423.14, 424.1; 415/203

See application file for complete search history.

(56) References Cited

U.S. PATENT DOCUMENTS

| | | | | |
|---|---|---|---|---|
| 4,172,695 | A * | 10/1979 | Uesugi | 417/423.14 |
| 5,360,317 | A * | 11/1994 | Clausen et al. | 415/206 |
| 6,109,891 | A * | 8/2000 | Sato | F04D 13/06 417/423.1 |
| 7,280,357 | B2 * | 10/2007 | Tomioka | F04D 29/5866 165/80.4 |
| 7,312,986 | B2 * | 12/2007 | Tomioka et al. | 361/679.48 |
| 7,384,237 | B2 * | 6/2008 | Baecke et al. | 415/205 |
| 2005/0210622 | A1 * | 9/2005 | Baecke | A61M 16/0057 15/330 |
| 2005/0226745 | A1 * | 10/2005 | Seko et al. | 417/423.14 |
| 2005/0232795 | A1 * | 10/2005 | Seko et al. | 417/423.14 |
| 2006/0045776 | A1 * | 3/2006 | Kalavsky | 417/423.14 |
| 2007/0243086 | A1 * | 10/2007 | Sakai et al. | 417/423.1 |
| 2008/0104992 | A1 * | 5/2008 | Lai et al. | 62/435 |

* cited by examiner

*Primary Examiner* — Alexander Comley

(57) ABSTRACT

A micropump structure including a main body, at least one water room partitioning board, at least one fan propeller and at least one drive unit. The main body has at least one water room, an inlet and an outlet. The inlet and the outlet are disposed on a circumference of the main body in communication with the water room. The water room partitioning board is disposed in the water room to divide the water room into at least one water incoming section and at least one water discharging section. The fan propeller is disposed in the water room. The drive unit is disposed in the main body. The water room partitioning board enhances the flow guiding efficiency of the micropump and reduces the axial height of the micropump so that the working efficiency is promoted and less room is occupied.

6 Claims, 5 Drawing Sheets

MICROPUMP STRUCTURE

FIELD OF THE INVENTION

The present invention relates to an improved micropump structure with greatly reduced axial height and enhanced working efficiency.

BACKGROUND OF THE INVENTION

Please refer to FIG. 1, which is a sectional assembled view of a conventional micropump. The conventional micropump 3 is mounted in a liquid reservoir 5 in which a cooling liquid 4 is contained. The micropump 3 includes a casing 315 a top sealing cover 32, a fan 33 and a bottom sealing cover 34. The casing 31 and the top sealing cover 32 together define a flow space 35 in which the fan 33 is accommodated. The top sealing cover 32 has a liquid inlet 351 and a liquid outlet 352. The bottom sealing cover 34 has a bottom face 341 formed with a guide groove 342. A water outlet 343 and an exhaust port 344 are formed in the guide groove 342 at an interval in communication with the flow space 35. The water outlet 343 has a diameter slightly larger than that of the exhaust port 344. One end of the guide groove 342 extends to one side of the bottom sealing cover 34 to communicate with the liquid reservoir 5. The micropump serves to expedite flowing of the cooling liquid within the liquid reservoir 5. However in such micropump 3, the casing 31, the top sealing cover 32 and the bottom sealing cover 34 are assembled to together define the closed flow space 35. Such structure has so many junctures that the tightness is relatively poor. As a result, leakage of the liquid is apt to take place. Moreover, the liquid inlet 351 of the micropump 3 is positioned on the top of the top sealing cover 32. Therefore, the cooling liquid 4 must flow into the liquid inlet 351 and then flows out of the liquid outlet 352 positioned on a circumference of the top sealing cover 32. That is, the cooling liquid 4 axially enters the micropump 3 and then radially flows out of the micropump 3. Under such circumstance, the micropump 3 has a considerable axial height as a whole. This makes it difficult to apply the micropump 3 to a site with smaller room. According to the aforesaid, the conventional micropump has the following defects:

1. The conventional micropump has higher axial height.
2. The application range of the conventional micropump is narrow.
3. The conventional micropump has poor leakproofness.

SUMMARY OF THE INVENTION

A primary object of the present invention is to provide an improved micropump structure with greatly reduced axial height and enhanced working efficiency.

A further object of the present invention is to provide the above micropump structure, which has better tightness.

To achieve the above and other objects, the micropump structure of the present invention includes a main body, at least one water room partitioning board, at least one fan propeller and at least one drive unit. The main body has at least one water room, an inlet and an outlet. The inlet and the outlet are disposed on a circumference of the main body in communication with the water room. The water room partitioning board is disposed in the water room to divide the water room into at least one water incoming section and at least one water discharging section. The inlet and the outlet respectively communicate with the water incoming section and the water discharging section. The fan propeller is disposed in the water room. The drive unit is disposed in a drive unit receiving space of the main body. The water room partitioning board is disposed in the water room to more efficiently guide a heat dissipation fluid. Therefore, the flow guiding efficiency of the micropump is greatly enhanced with the axial height of the micropump reduced and the working room saved. Moreover, the drive unit receiving space and the water room are independent from each other without communicating with each other so that the micropump has better tightness. According to the aforesaid, the present invention has the following advantages:

1. The axial height of the micropump is reduced.
2. The micropump has better tightness.
3. The micropump has better working efficiency.
4. The micropump occupies less working room.

BRIEF DESCRIPTION OF THE DRAWINGS

The structure and the technical means adopted by the present invention to achieve the above and other objects can be best understood by referring to the following detailed description of the preferred embodiment and the accompanying drawings, wherein.

DETAILED DESCRIPTION OF THE PREFERRED EMBODIMENT

Figure 1:
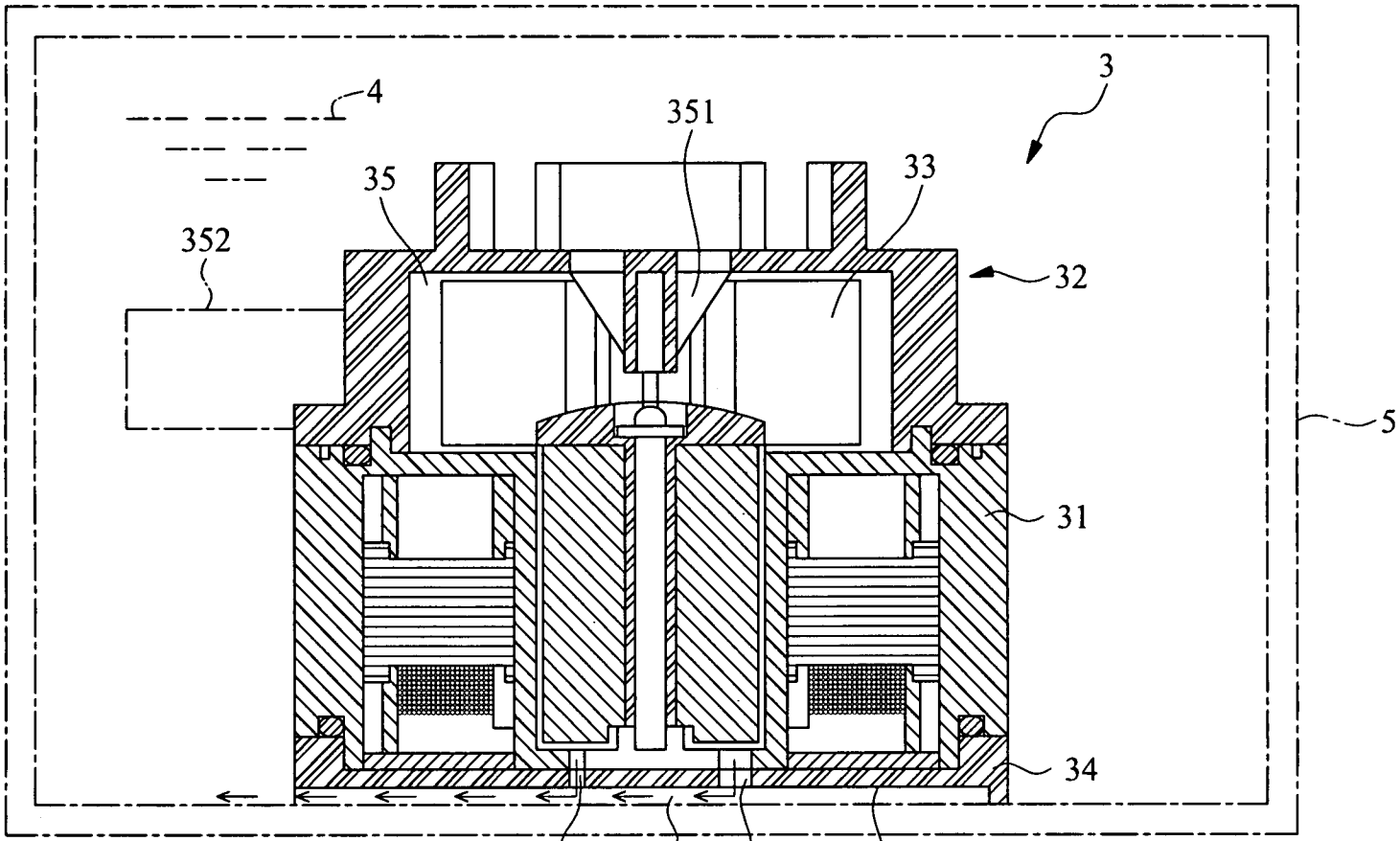
FIG. 1 (PRIOR ART)
FIG. 1 is a sectional assembled view of a conventional micropump.
Figure 2:
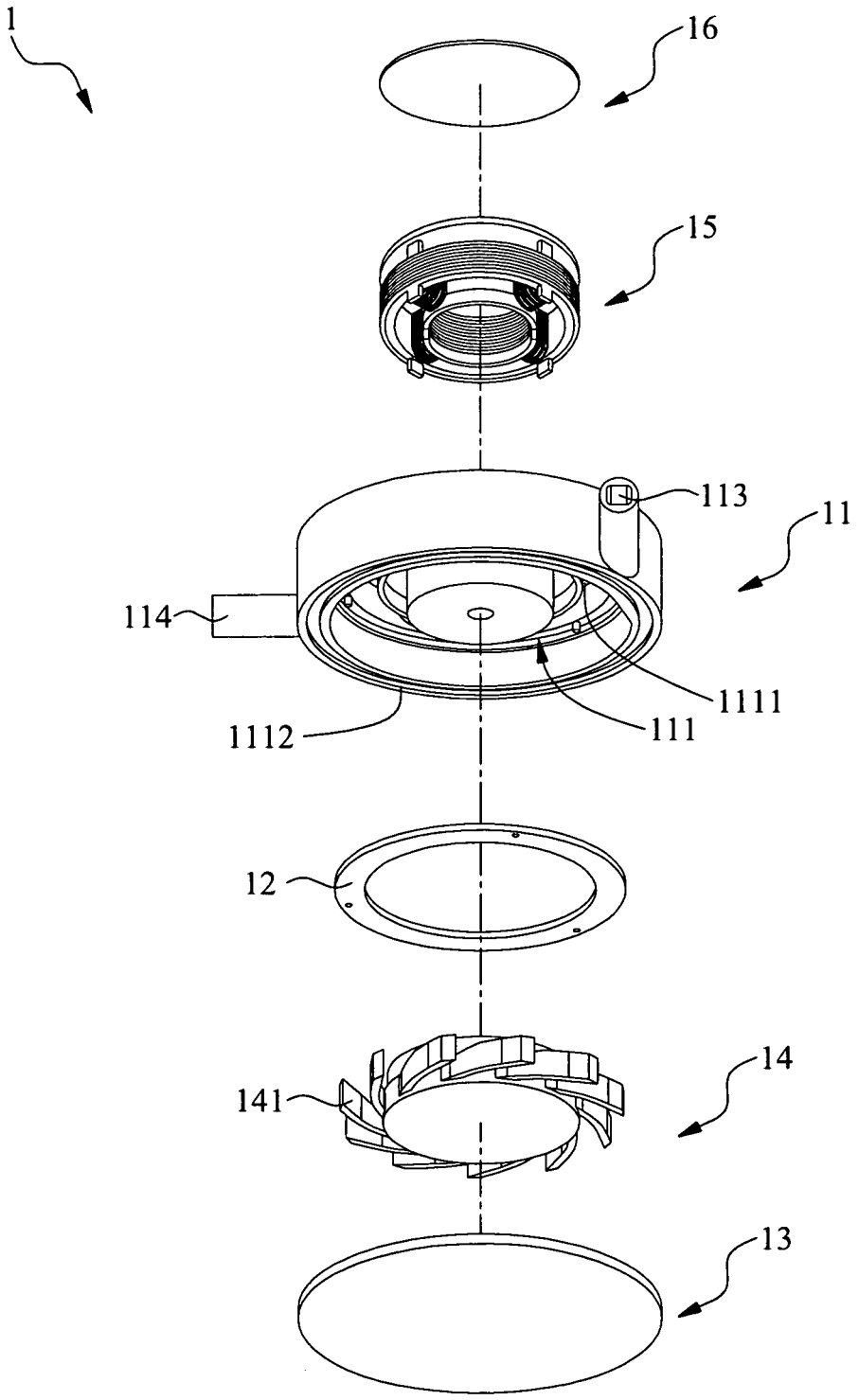
FIG. 2 is a perspective exploded view of the present invention.
Figure 3:
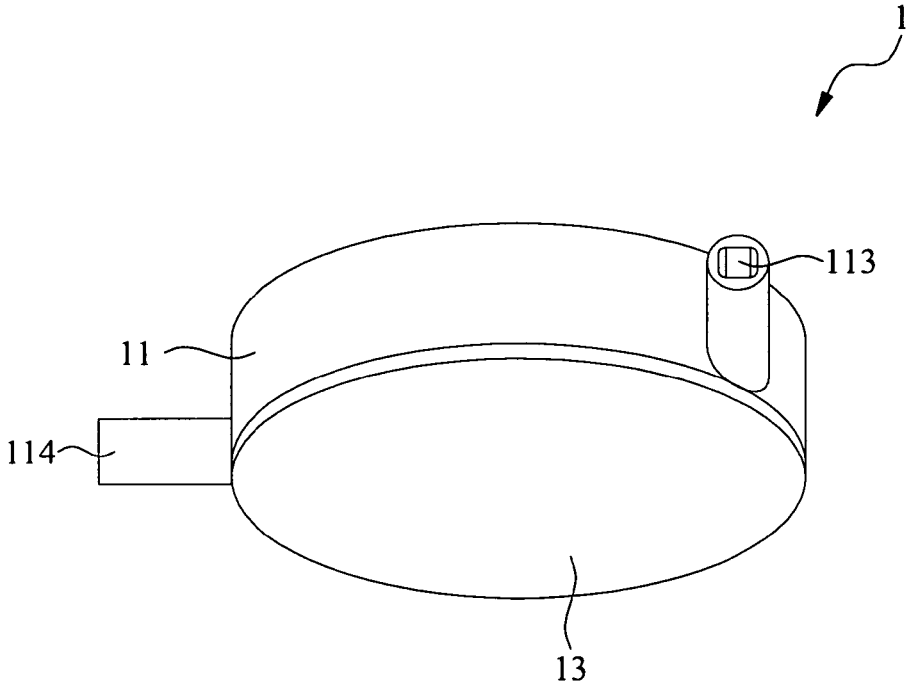
FIG. 3 is a perspective assembled view of the present invention.
Figure 4:
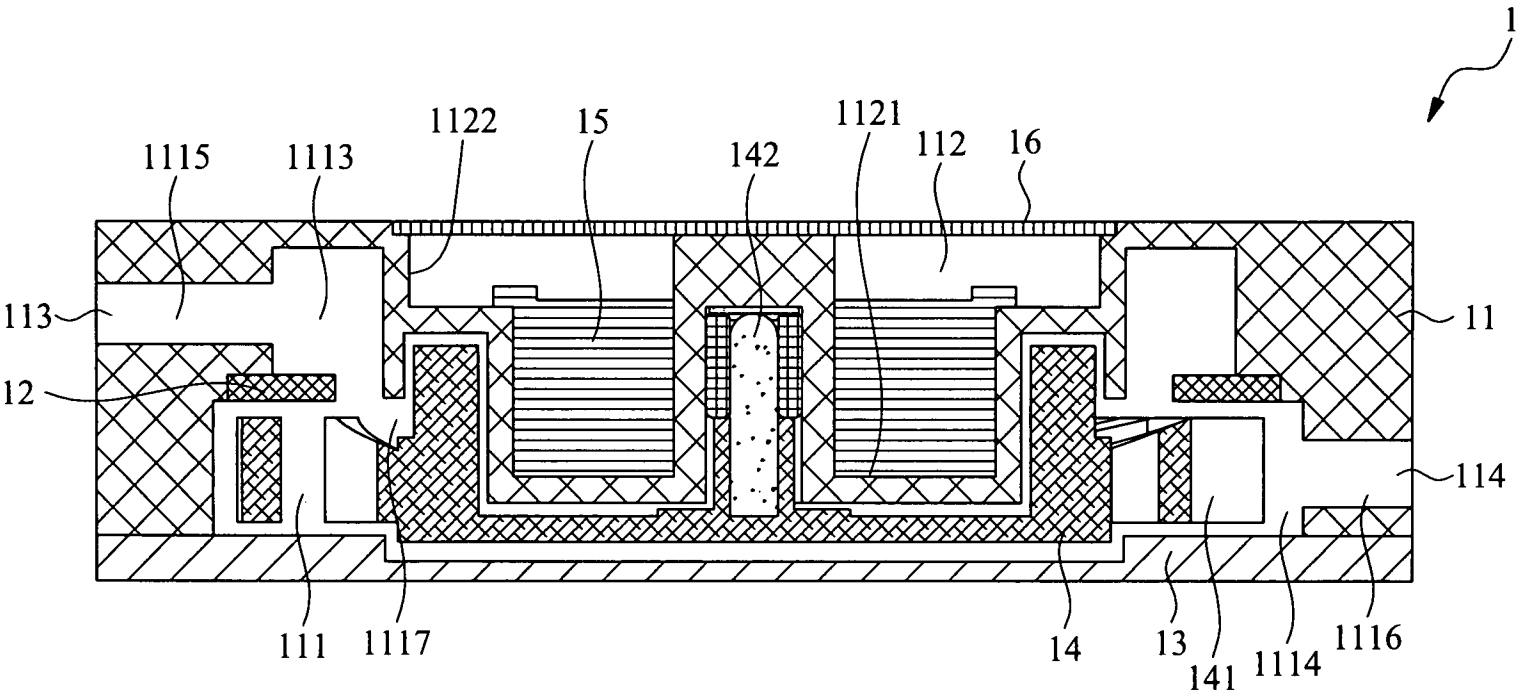
FIG. 4 is a sectional assembled view of the present invention.

Please refer to FIGS. 2, 3 and 4, in which FIG. 2 is a perspective exploded view of the present invention, FIG. 3 is a perspective assembled view of the present invention and FIG. 4 is a sectional assembled view of the present invention. The micropump structure 1 of the present invention includes a main body 11, at least one water room partitioning board 12, at least one fan propeller 14 and at least one drive unit 15. In this embodiment, the drive unit 15 is a motor. The main body 11 has at least one water room 111, a drive unit receiving space 112, an inlet 113 and an outlet 114. The water room 111 and the drive unit receiving space 112 are respectively disposed at two ends of the main body 11. The inlet 113 and the outlet 114 are disposed on a circumference of the main body 11 in communication with the water room 111. Referring to FIG. 4, the water room partitioning board 12 is disposed in the water room 111 to divide the water room 111 into at least one water incoming section 1113 and at least one water discharging section 1114. A water incoming passage 1115 is formed between the water incoming section 1113 and the inlet 113 for communicating the water incoming section 1113 with the inlet 113. A water discharging passage 1116 is formed between the water discharging section 1114 and the outlet 114 for communicating the water discharging section 1114 with the outlet 114. In addition, an axial height difference exists between the inlet 113 and the outlet 114. The fan propeller 14 is disposed in the water room 111 of the main body 11. The drive unit 15 is mounted in the drive unit receiving space 112 of the main body 11. The fan propeller 14 has multiple blades 141 and a shaft 142. The water room 111 further has at least one water reservoir 1117 formed at root sections of the blades 141. Moreover, the water room 111 has a first closed side 1111 and a first open side 1112. A first cover body 13 is mated with the first open side 1112 to close the water room 111. The drive unit receiving space 112 has a second closed side 1121 and a second open side 1122. A second cover body 16 is mated with the second open side 1122 to close the drive unit receiving space 112.

Figure 5:
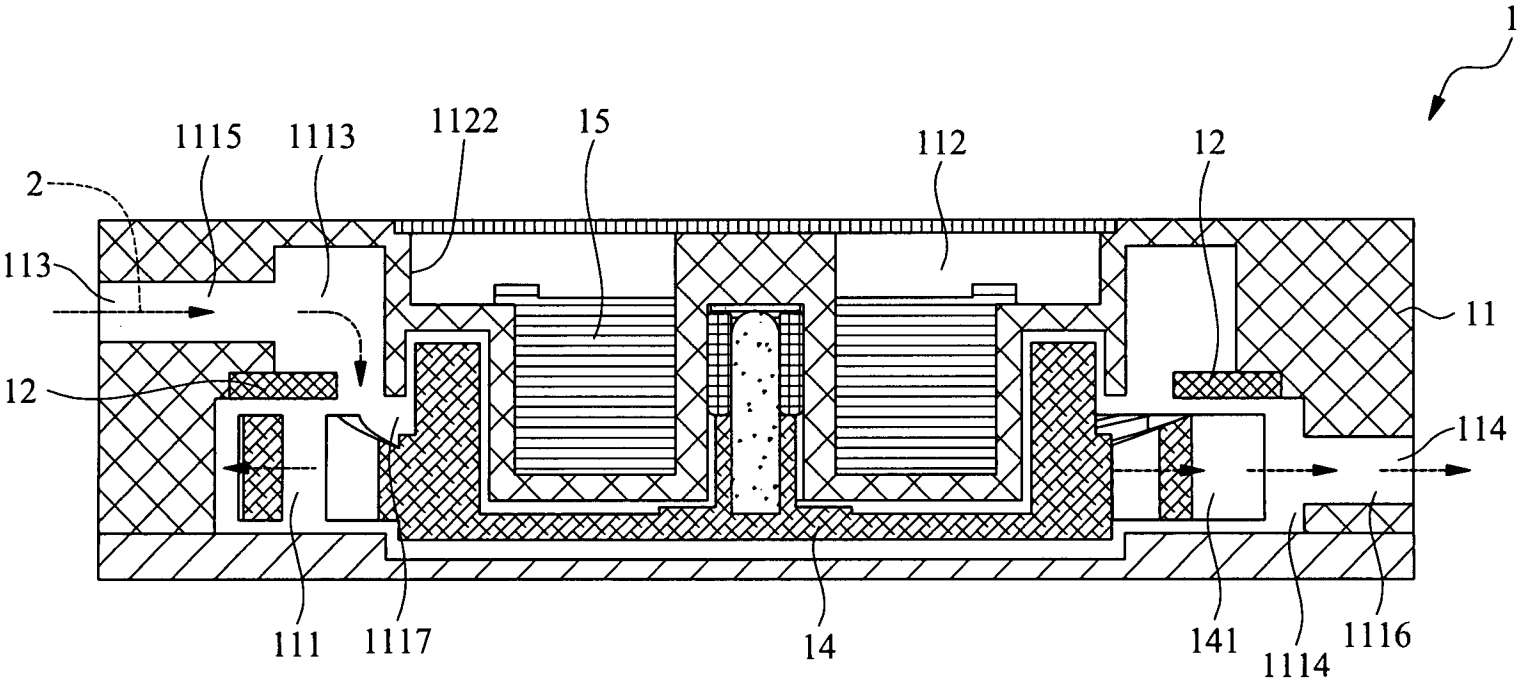
FIG. 5 is a sectional view according to FIG. 4, showing the operation of the present invention.

Please refer to FIG. 5, which shows the operation of the present invention. A heat dissipation fluid 2 first flows into the inlet 113 on the circumference of the main body 11. The heat dissipation fluid 2 then flows through the water incoming passage 1115 into the water incoming section 1113 of the water room 111. Then, the water room partitioning board 12 guides the heat dissipation fluid 2 from the water incoming section 1113 into the water reservoir 1117 at the root sections of the blades 141. Then the blades 141 of the fan propeller 14 rotate to create centrifugal force for driving the heat dissipation fluid 2 to flow from the water reservoir 1117 into the water discharging section 1114. Finally, the heat dissipation fluid 2 flows from the water discharging section 1114 into the water discharging passage 1116 and flows from the outlet 114 out of the main body 11. The water room partitioning board 12 not only serves to buffer the impact of the heat dissipation fluid 2, but also serves to directly guide the heat dissipation fluid 2 into the water reservoir 1117. As shown in FIG. 5, an axial height difference exists between the inlet 113 and the outlet 114. That is, the inlet 113 is higher than the outlet 114. Accordingly, when the heat dissipation fluid 2 flows into the water room 111, due to the height difference between the inlet 113 and the outlet 114 and the rotation of the cooperative fan propeller 14, the heat dissipation fluid 2 can flow more smoothly. Moreover, the drive unit receiving space 112 and the water room 111 are independent from each other without communicating with each other so that better tightness is achieved. Accordingly, the heat dissipation fluid 2 can circulate within the water room 111.

The micropump 1 of the present invention is characterized in that the inlet 113 and the outlet 114 are arranged on the circumference of the main body 11. This can greatly reduce the axial height of the micropump 1 as a whole. In addition, the water room partitioning board 12 is disposed in the water room 111 to directly guide the heat dissipation fluid 2 from the water incoming section 1113 into the water reservoir 1117. The drive unit 15 drives and rotates the fan propeller 14, which drives the heat dissipation fluid 2 to flow to the water discharging section 1114 and flow out of the main body 11. In other words, the water room partitioning board 12 not only, serves to smoothen flowing of the heat dissipation fluid 2, but also serves to buffer the impact of the heat dissipation fluid 2. Therefore, the micropump of the present invention has higher working efficiency and occupies less room than the conventional micropump.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A micropump structure comprising: at least one drive unit; a main body having a generally flat round structural shape and comprising, on a common plane, a water room and a drive unit receiving space, the main body having an inlet and an outlet being disposed in an arrangement and in an opposed relation such that an axis of the inlet is disposed at a generally perpendicular angle relative to an axis of the outlet about a circumference of the main body in communication with the water room, the drive unit receiving space being formed at one end of the main body opposite to the water room and having a first closed side and a first open side, the drive unit receiving space and the water room being independent from each other without communicating with each other, wherein the entire drive unit is disposed in the drive unit receiving space and surrounded by the water room, wherein a partition wall is provided between the drive unit and the water room, the partition wall having a closed bottom side; a water room partitioning board in the form of an annulus disposed in the water room to divide the water room into independent separate spaces including at least one water incoming section and at least one water discharging section; at least one pump impeller disposed in the water room opposite to the drive unit and corresponding to the drive unit and having multiple blades; a first cover body being mated with the first open side to close the drive unit receiving space; wherein the inlet is disposed at a location axially above the outlet relative to a rotation axis of the pump impeller; wherein the inlet and the outlet respectively communicate with the water incoming section and the water discharging section; wherein the inlet communicates with the water incoming section via at least one water incoming passage; and wherein the water room further has at least one water reservoir formed at root sections of the pump impeller; wherein the water room partitioning board is disposed at a location axially above the impeller blades relative to the rotation axis; and wherein the water incoming section is disposed axially above the water room partitioning board and the water reservoir is disposed axially below the water room partitioning board: and wherein the water room partitioning board guides incoming fluid to flow axially downward toward the impeller.

2. The micropump structure as claimed in claim 1, further comprising a second cover body, wherein the second cover body is mated with the main body.

3. The micropump structure as claimed in claim 2, wherein the water room has a second closed side and a second open side, wherein the second cover body is mated with the second open side to close the water room.

4. The micropump structure as claimed in claim 1, wherein the outlet communicates with the water discharging section via at least one water discharging passage.

5. The micropump structure as claimed in claim 1, wherein the pump impeller has multiple blades and a shaft.

6. The micropump structure as claimed in claim 1, wherein the drive unit is a motor.

* * * * *